United States Patent [19]

Dobbins et al.

[11] Patent Number: 4,842,120

[45] Date of Patent: Jun. 27, 1989

[54] JAM REDUCING APPARATUS FOR USE IN A COIN OPERATED MACHINE

[75] Inventors: Bob M. Dobbins, Villanova; Raymond D. Regan, Downington; John Zouzoulas, Westchester, all of Pa.

[73] Assignee: Mars, Incorporated, McLean, Va.

[21] Appl. No.: 188,038

[22] Filed: Apr. 29, 1988

[51] Int. Cl.[4] ..... G07F 1/02

[52] U.S. Cl. ..... 194/349; 194/351; 194/202

[58] Field of Search ..... 194/202, 347, 349, 351

[56] References Cited

U.S. PATENT DOCUMENTS

| | | | |
|---|---|---|---|
| 1,309,294 | 7/1919 | McLaughlin | 194/347 |
| 4,660,706 | 4/1987 | Wollet | 194/351 |

FOREIGN PATENT DOCUMENTS

| | | | |
|---|---|---|---|
| 2504294 | 10/1982 | France | 194/349 |
| 501569 | 3/1939 | United Kingdom | 194/351 |

*Primary Examiner*—Andres Kashnikow
*Assistant Examiner*—Patrick N. Burkhart
*Attorney, Agent, or Firm*—Davis Hoxie Faithfull & Hapgood

[57] ABSTRACT

Jam reducing apparatus for use in coin operated machines, such as telephones, acts to prevent the insertion of coins when the entryway is obstructed by foreign matter, assists in dislodging jammed coins and discourages vandals. The apparatus comprises a coin entryway which includes an inclined surface as part of a flared end of a lid. An entry slot in an entrance blocker, which is an integral part of the lid, as in substantial alignment with the coin insert slot of the front panel of the machine in normal operation. The lid is connected to a torsion spring and is associated with a coin reject lever. The inclined surface of the entryway lies opposite the blocker slot and is angled toward an exit of the coin entryway, which directs a coin into the machine. In normal use, inserted coins pass through the entryway and are directed into a coin mechanism for coin testing. Foreign matter inserted into the machine hits the inclined surface and exerts a camming force on the lid, rotating the lid about a torsion spring. This moves the coin entry slot and the blocker slot out of substantial alignment, preventing the insertion of additional foreign matter or another coin. Removal of the foreign matter allows the lid to return to its normal operating position under the force of the spring.

4 Claims, 6 Drawing Sheets

JAM REDUCING APPARATUS FOR USE IN A COIN OPERATED MACHINE

FIELD OF THE INVENTION

This invention relates generally to coin entryways in coin operated machines and, more particularly, to a coin entryway for a coin operated machine, such as a telephone, which operates to tend to both prevent the loss of money by a legitimate customer when the coin entryway is partially jammed with foreign material, and to prevent the use of a machine which has been completely jammed by the presence of foreign matter inserted into the coin entryway.

BACKGROUND OF THE INVENTION

Coin operated machines, such as payphones, vending machines and pinball machines, typically include a slot in a front panel for receiving the coin or coins required for their operation. A customer typically inserts a coin into the machine by pushing it through the slot in the front panel. From the slot, the coin is directed by a coin passageway to one or more coin test stations which test the coin's validity. If a coin is valid it is directed to an accept chute and the customer is given credit. Because a coin must be able to travel freely from the slot along the coin passageway, these machines are vulnerable to vandalism and abuse due to the insertion of foreign matter, such as paper, straws, or other materials through the slot where the foreign material can block the coin passageway.

One common scam is to insert material into the slot of such a machine to obstruct the coin passageway. When an unsuspecting customer inserts a coin or coins into the slot, the coins jam in the coin passageway due to the obstruction. After the frustrated customer leaves, the vandal, using a paper clip or other suitable instrument, removes the coins by fishing them out, or dislodges the coins by rapidly and violently operating the coin return lever to shake them loose.

In prior coin mechanisms, coins enter the mechanism through a coin entry. Under the influence of gravity, the coins progress downward between front and back plates. Each coin rolls or slides on its edge along successive coin tracks and is subjected to one or more tests of coin genuineness and denomination by coin sensors mounted adjacent the coin passageway. In order to allow for jams to be cleared and for periodic cleaning, the lid typically is mounted to the deck with a hinge and a spring is provided to bias the lid to a normally closed position. See, for example, U.S. Pat. No. 3,907,086 assigned to the assignee of the present invention. To clear jams or clean the mechanism, the lid is opened by the serviceman to gain access to the coin passage.

It is further known to construct a coin mechanism so that rotation of a coin return lever causes the front plate and a portion of the coin track mounted on the front plate to move out of their normal position allowing a jammed or escrowed coin to fall into a return chute which directs the coin to a return slot where it can be retrieved by the customer.

It is also known in coin operated telephones to provide a blocking mechanism which operates upon rotation of the coin return lever to block the coin insert slot. The blocking mechanism ceases to block the coin insert slot once the coin return lever is released. This operation prevents the insertion of additional coins while coins are being returned.

Further, U.S. Pat. No. 4,660,706 describes an adaptation of an industry standard mechanical acceptor-rejector mechanism. While the operation of this adaptation is not entirely clear, this patent does describe providing a slideably mounted door with a coin slot which misaligns with a coin slot in the face plate of a coin telephone. The apparatus is mechanically relatively complex.

While prior art mechanisms partially address the jamming problems encountered in every day operation, jamming continues to occur at unacceptably high levels particularly in coin operated telephones which are left unsupervised for long periods of time. Obstructed machines require service calls to clear them. Such service involves various degrees of dismantling of the machine. For example, a large number of presently operated payphones include electromechanical coin testing sensors whose operation may be disrupted by interfering material thereby necessitating readjustment. Furthermore, a jammed machine is put out of service until it is repaired, resulting in a loss of revenue and disgruntled customers who cannot use the telephone or machine, or worse, who physically abuse the machine because it has taken their money.

It is therefore an object of the present invention to discourage the vandalism of coin operated machines by providing a coin entryway which tends to prevent customers from inserting coins into a machine which has been obstructed.

It is another object of the present invention to provide a jam reducing coin entryway apparatus for coin operated machines, such as a coin operated telephone, which tends to provide a pathway for coins to a reject chute when foreign matter prevents a coin's entry to the accept chute of the machine thereby tending to insure that the customer does not lose his money even if the machine is jammed.

It is a further object of the present invention to provide a coin entryway apparatus which forces most jams to occur proximate the point at which coins are to be inserted thereby making it possible for a customer to either observe that a jam condition exists or to remove a coin which has been partially inserted into an obstructed machine.

It is a further object of the present invention to provide a jam reducing coin entryway apparatus suitable for use with a coin mechanism with electronic coin testing sensors which can be easily retrofitted into a standard coin operated telephone.

SUMMARY OF THE INVENTION

As will be described in greater detail below, a jam reducing apparatus according to the present invention provides a mechanically simple technique for reducing problems as a result of the intentional stuffing of coin operated machines.

According to the present invention, the jam reducing apparatus comprises a lid having an extended portion and a flared end. The flared end includes an inclined inner surface and an integral entrance blocker substantially parallel to the front panel of the coin operated machine. There is also a deck substantially parallel to the extended portion of the lid. A first inclined coin track is connected to the deck, starting proximate the front panel, providing a pathway into the machine. The lid, deck and coin track define a coin entryway proximate the front panel, which directs a coin into the machine. Access to the entryway is through a coin insert slot in the front panel of the machine and an entrance slot in the entrance blocker. The lid and deck are hingedly mounted together and the lid has a normally closed position in which the panel slot and the entrance slot are in substantial alignment. The lid is subject to movement from its normally closed position due to a sufficient camming force exerted on the inclined surface, moving the insert slot and the entrance slot out of alignment, preventing the insertion of foreign matter or coins.

The spring constant of the spring can be selected so that sufficient camming force to misalign the slots can be caused by the insertion of foreign matter.

The lid further comprises a second inclined coin track which begins at the point where the first coin track ends. The second coin track covers a reject chute. Rotation of a coin reject lever moves the lid from its normally closed position, opening the reject chute.

DESCRIPTION OF THE INVENTION

Figure 1:
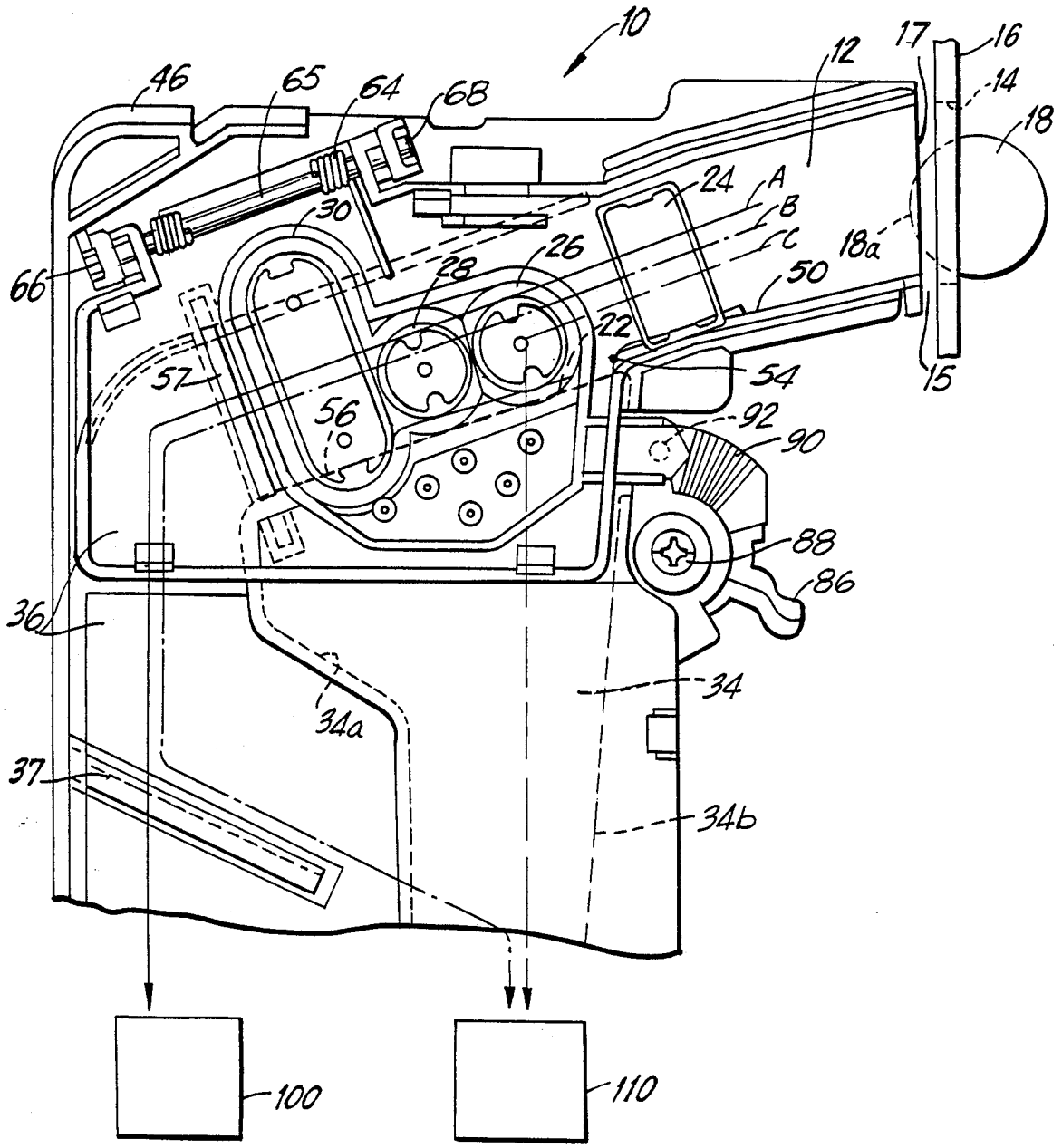
FIG. 1 shows a left side view of the top portion of a coin mechanism having jam reducing coin entry apparatus according to the present invention.

FIG. 1 is a cross-sectional view illustrating the top portion of a coin mechanism 10 for use in a coin operated telephone. The bottom portion of coin mechanism 10, which serves to direct coins either to a cashbox 100 or a coin return slot 110 from which the customer retrieves the coin or coins in known fashion. Coin mechanism 10 includes a coin entryway 12 constructed in accordance with the present invention. In FIG. 1, a coin 18 having a leading edge 18*a* is inserted through a coin slot 14 (best seen in FIG. 2) through a front panel 16 of a coin operated telephone. The width of the coin slot 14 is typically slightly wider than the width of the widest coin which the coin operated telephone is set up to accept, and the height of coin slot 14 is similarly slightly larger than the diameter of the largest coin to be accepted so that coins or objects which are too large are physically rejected. Once the leading edge 18*a* of a coin of nominally acceptable size, such as the coin 18, has passed through the coin slot 14, it next passes through a narrow gap 15 located between the front panel 16 and the coin mechanism 10, and comes to a entrance slot 17 (best seen in FIG. 2) through which coin 18 enters the coin mechanism 10. The entrance slot 17 is wider than the coin slot 14 as will be discussed further below. The coin passes through the coin entryway portion 12 of coin mechanism 10 as described further below in conjunction with a discussion of FIG. 2. After passing through the coin entryway 12, coin 18 rolls or slides as it is directed along a coin passageway defined by front and rear walls of the coin mechanism 10, and coin tracks supported by those walls. Coin 18 proceeds past a sensor 24 arranged adjacent the path of the coin's travel along the coin passageway. This sensor 24 is utilized to perform a number of functions including sensing the presence of a coin and detecting the presence of a foreign object, such as paper, jammed into coin mechanism 10.

From the coin sensor 24, coin 18 can follow one of three paths A, B, or C. If the customer operates a coin return lever 86 (whose operation is described further below) immediately after inserting the coin 18, the coin 18 will be guided along the path C, represented schematically by long dashed lines in FIG. 1 to a reject chute 34 located between dashed lines 34*a* and 34*b* which directs the coin 18 to the coin return slot 110. If the coin return lever 86 has not been operated, the coin 18 travels down an inclined coin track 22 past coin sensors 26, 28, and 30, past a blocker 56, and falls vertically down a coin guiding chute 36 onto a coin directing gate 37. The gate 37 directs the coin 18 either to the cashbox 100 or to the coin return slot 110. If the coin 18 is determined by the tests of the sensors 26, 28 and 30 to be a valid coin of acceptable denomination, gate 37 is activated to allow the coin 18 to pass through an opening in the gate 37 and fall into the cashbox 100. Consequently, the coin 18 follows path A shown in FIG. 1 as a solid line. If the coin 18 is judged to be unacceptable, the gate 37 remains inactive in its home position and its inclined surface directs the coin 18 along the path B shown in FIG. 1 as a dashed line made up of long and short dashes, and into the coin return slot 110.

Turning to the details of the sensors 24, 26, 28 and 30, these sensors are positioned along the incline 22. As briefly discussed above, the sensor 24 detects the presence of a coin its path and can also detect the presence of foreign matter inserted into entryway 12. A suitable sensing device for use as sensor 24 is described in U.S. Pat. No. 4,413,718, assigned to the assignee of the present invention. This sensor utilizes a light source and a detector on one side of a coin passage and a prism on the other so that coins and other objects are more reliably detected. Light emitted by the source is reflected by the prism to the detector, which detects a blockage of either the emitted or reflected light beam due to the passage of a coin or presence of foreign matter. The remaining sensors, 26, 28 and 30, test a variety of a coin's characteristics, such as its thickness, material and diameter to determine whether the coin is valid and of the proper denomination. The details of these coin sensors are not part of the present invention, however, electronic coin sensors are preferred because they can be arranged in known fashion to present a relatively smooth coin passageway which is more readily cleaned and which is more resistant to jamming than the typical electromechanical sensing arrangement. By way of example, coin testing can be carried out in accordance with the techniques of one or more of the following U.S. Pat. Nos. 3,739,895; 3,870,137; 3,918,564; 3,918,565; 4,316,218;

4,462,513; 4,460,003; 4,461,365, 4,601,380; and 4,538,719; all of which are assigned to the assignee of the present invention.

Figure 2:
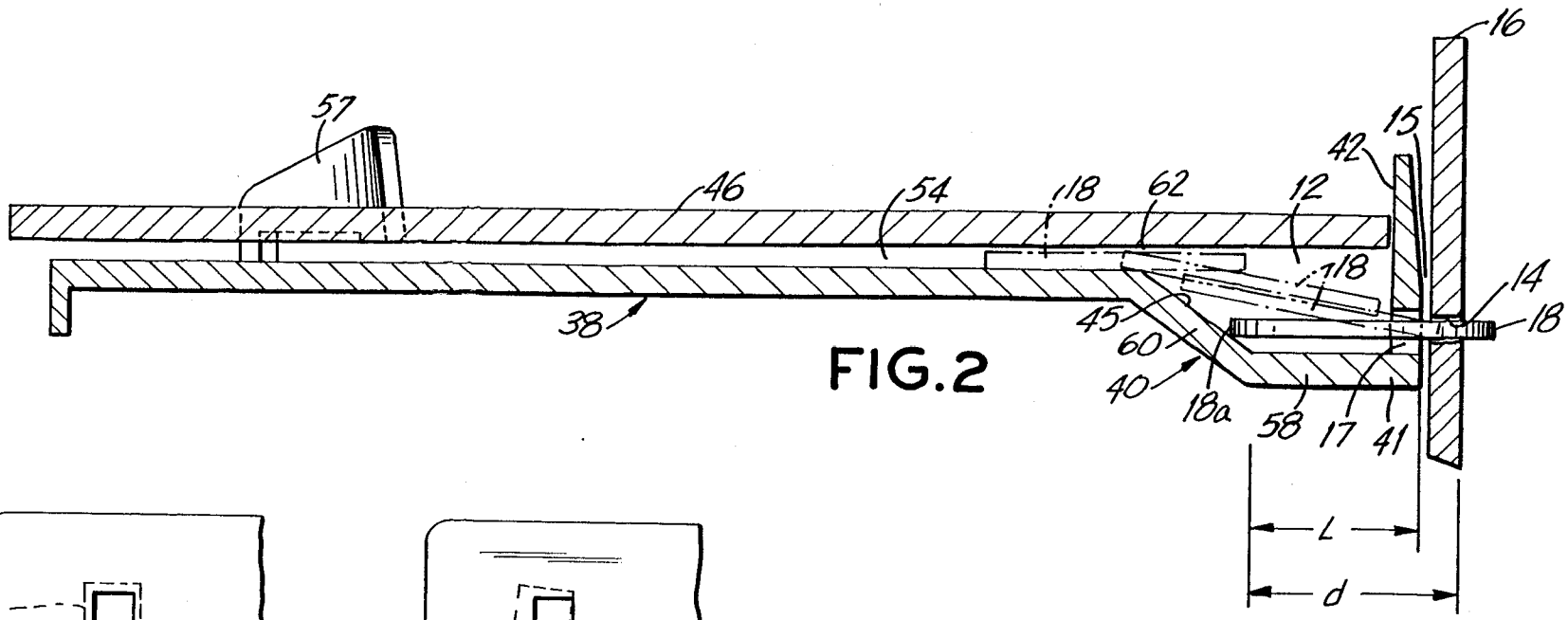
FIG. 2 shows a top view cross-section of the coin entryway portion of the coin mechanism of FIG. 1 and its relation to the front panel of a coin operated telephone, and illustrates the path a coin follows immediately after its insertion through the coin slot in the front panel of the coin operated telephone.

FIGS. 1 and 2 also show an entrance blocker 57, which is located downstream of the coin sensor 30. The blocker 57 operates when lid 38 is open to prevent coins from proceeding into chute 36.

FIG. 2 shows a top view of the entryway 12 with four separate outlines of the body of the coin 18 shown so as to illustrate the coin's movement through entryway 12. The entryway 12 is defined in part by first wall or lid 38, which has a flared end 40. A perpendicular member 42, referred to as an entrance blocker, extends substantially perpendicular to an end 41 of flared end 40 and is substantially parallel to the front panel 16. The entrance blocker 42 has an entrance slot 17 located so that when lid 38 is in its normal closed position, the leading edge 18*a* of coin 18 passes directly through the slot 17, and impacts an inner inclined surface 45 of the flared end 40 of the lid 38. The entry blocker slot 17 is wider than the front panel slot 14 to ensure that slots 14 and 17 are in substantial alignment when lid 38 is in its normal closed position.

A second wall or deck 46, is substantially parallel to lid 38 (except for the flared end portion 40), and extends along the length of lid 38, up to the entrance blocker 42. The two walls 38 and 46 define two boundaries of the coin passageway along which coins pass through coin mechanism 10. An additional boundary is defined by the incline 22 which is shown in FIG. 1 and which is comprised of a first coin track portion 50 (best seen in FIG. 6) and a second coin track portion 56.

Figure 4:
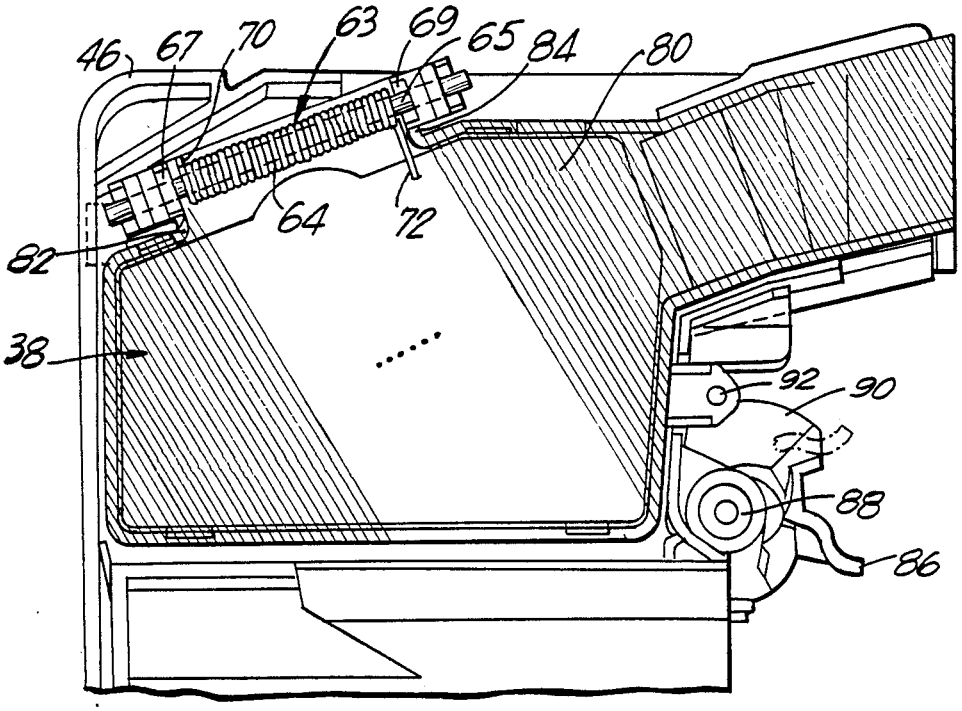
FIG. 4 shows an additional view of the top portion of the coin mechanism of FIG. 1, illustrating the front face of the lid in its closed position and the hinged connection of the lid and deck.
Figure 6A:
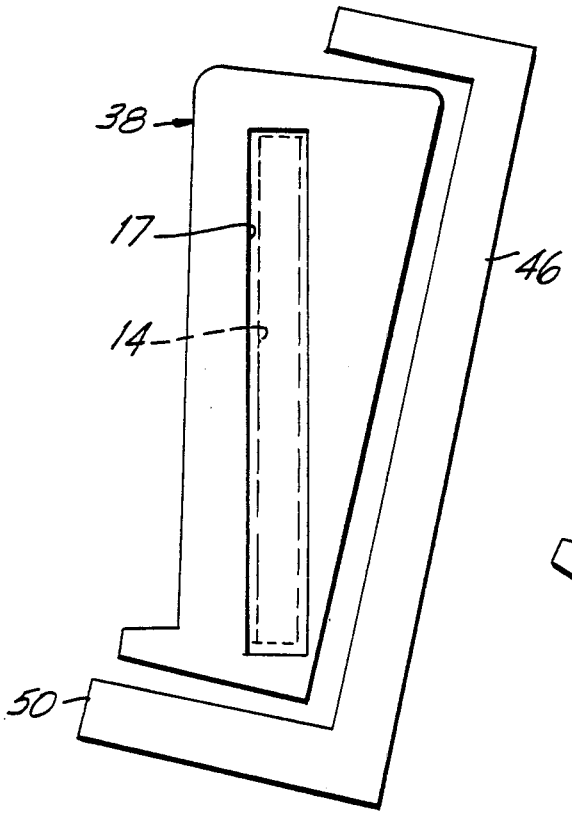
FIGS. 6A and 6B show a front elevational view of the coin entryway chamber, slot, deck and lid.
Figure 6B:
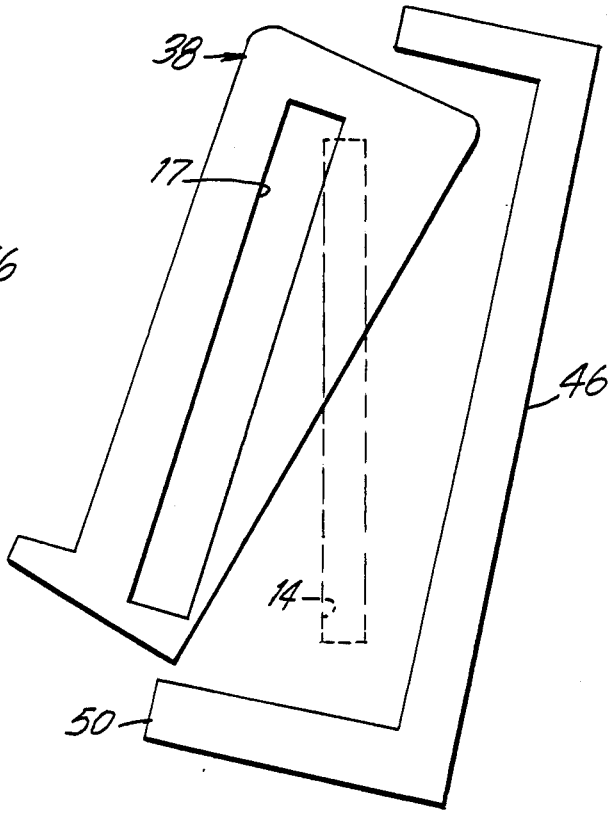

Lid 38 is connected to torsion spring 64, as shown in FIGS. 1 and 4, so that it can rotate about pin 65. As seen in FIGS. 6A and 6B, the first coin track 50 is mounted on the deck 46 and extends beyond the boundary of flared end 40 when lid 38 is in its normally closed position so that when lid 38 is rotated away from deck 46 by the customer's operation of the coin return lever 86, the coin 18 will still be enclosed in the entryway 12. The track 50 is connected substantially perpendicular to the front portion of deck 46. Flared end 40, blocker 42, deck 46 and first track 50 define an entryway 12 for receiving the coin 18 after its insertion through the slots 14 and 17. At a point 54, the first track 50 ends and the second coin track portion 56 begins. Second track 56 is connected substantially perpendicular to lid 38. When lid 38 is rotated away from deck 46, the second coin track 56 also moves away from deck 46 thereby allowing the coin 18 to fall down and to be guided by the reject chute 34.

Figure 3B:
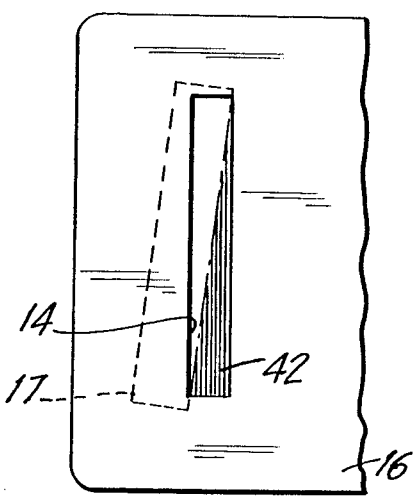
FIG. 3B shows a front view of the slots of FIG. 3*a* illustrating their movement out of alignment.
Figure 3A:
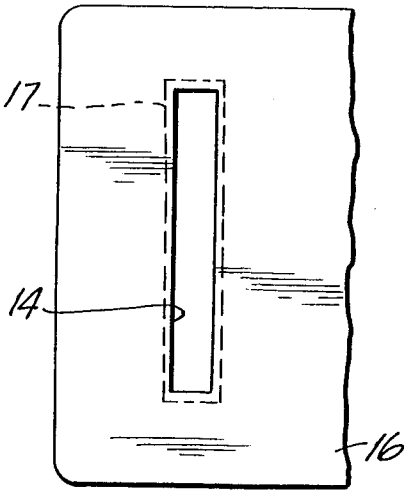
FIG. 3A shows a front view of the slots in the front panel of a coin operated telephone and a coin entryway of the coin mechanism of FIG. 1, showing their substantial alignment during normal operation.

Returning to entryway 12 (best shown in FIG. 2), the flared end 40 has a section 58 which is parallel to the deck 46 and a transverse section 60 connecting the section 58 to the remainder of the lid 38. An inner inclined surface 45 is part of the transverse section 58. Lid 38 has a first position in which the slots 14 and 17 are in substantial alignment, as shown in FIGS. 2 and 3*a*. This is the lid's normal position. When a coin 18 is inserted through the slots 14 and 17, it enters the coin entryway 12, as shown in FIG. 2. The leading edge 18*a* of coin 18 hits the surface 45. This impact slows the forward motion of coin 18 and directs coin 18 both to the right and downwardly toward an exit 62 which leads from the entry 12 to the remainder of coin mechanism 10. FIG. 2 illustrates the coin 18 in four different positions as it proceeds into and through the entryway 12. From the entryway 12, the coin 18 proceeds down first track portion 50 between lid 38 and deck 46, and onto the second track portion 56 as best seen in FIG. 1. Second coin track 56 begins at point 54 of FIGS. 1 and 2. It meets deck 46 when lid 38 is in its normally closed position.

In the presently preferred embodiment, coin mechanism 10 is designed to retrofit standard coin operated telephones which accept U.S. and Canadian 5-cent, 10-cent and 25-cent coins. The coin mechanism 10 is also designed for the future acceptance of the U.S. Susan B. Anthony dollar coins and Canadian dollar coins. Of these coins, the Canadian dollar coin is the largest having a thickness of approximately 2 millimeters (mm) and a diameter of approximately 27 mm. The Susan B. Anthony dollar coin is just smaller than the Canadian dollar coin having a diameter of approximately 26.5 mm. For use with the above coins, the following dimensions for the coin entryway 12 and its location with respect to front panel 16 are presently preferred. Front panel 16 is approximately 3 mm thick. The gap 15 between the entrance blocker 42 and the front panel 16 is approximately 1.5 mm. The entrance blocker 42 is approximately 3 mm thick and the entrance blocker slot 17 is approximately 5 mm wide and 30 mm high. The transverse section 60 of flared end 40 begins to make its bend with respect to the parallel section 58, at a distance, d, of approximately 26 mm from the front surface of the front panel 16.

The proximate location of the surface 45 with respect to the front surface of the front panel 16 causes a number of beneficial results. For example, it tends to severely restrict the area that can be jammed to one which is closely proximate the coin entry slot 14. With a straight-in coin entryway, foreign matter may be readily stuffed far into the coin mechanism so that the coin sensors may be disrupted. Also, material jammed into entryway 12 tends to cam against inclined surface 45 causing lid 38 to rotate away from the deck 46. As a result, the entry blocker 42 tends to move so as to block the slot 14 as illustrated in FIGS. 3A and 3B. FIG. 3A shows the slot 14 in the front panel 16 aligned with entry blocker slot 17. This alignment occurs when lid 38 is in its normally closed position. FIG. 3B, on the other hand, shows the slots 14 and 17 misaligned, and a shaded area which is a portion of blocker 42 which blocks slot 14. This arrangement occurs when lid 38 is partially opened. As the lid 38 is opened further, the blocking increases. This blocking action both tends to prevent further insertion of foreign matter and to alert a subsequent customer that the apparatus is jammed.

Focusing now on the mounting of the lid 38 to the deck 46 and returning to FIG. 1, it is seen that a torsion spring 64 mounted on a pin 65 which is secured at its ends 66 and 68 to the deck 46. The connection between ends 66 and 68 and the deck 46 is best illustrated in FIG. 4. A first spring end 70 is inserted into deck 46 while a second spring end 72 extends across a front face 80 of the lid 38. This front face 80 is indicated by shading lines in FIG. 4. Lid 38 includes end pieces 82 and 84 which fit into grooves 67 and 69 in torsion spring assembly 63. Consequently, by applying a force greater than that of torsion spring 64, the lid 38 may be rotated about an axis defined by the pin 65.

Figure 5A:
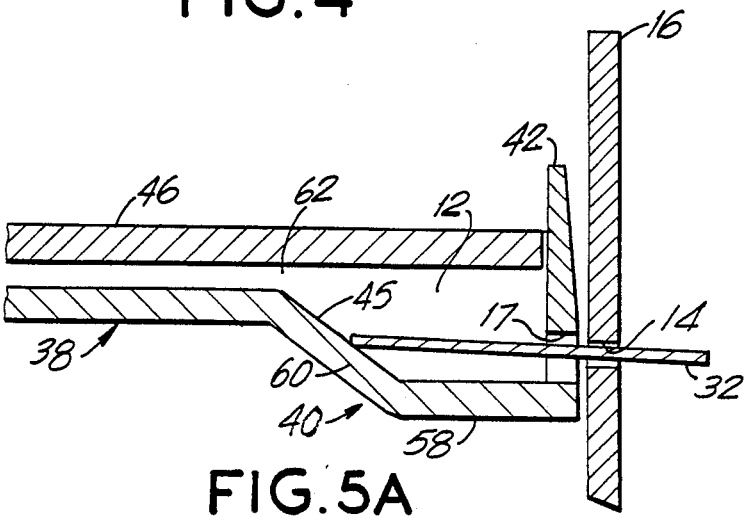
FIG. 5A shows foreign matter such as a stiff piece of cardboard being inserted into the coin entryway.

When foreign matter is inserted into coin entryway 12, the effect will depend on its stiffness, size and the force with which it is inserted. For example, a stiff piece of cardboard 32, as illustrated in FIG. 5A, if forcefully inserted, will hit the inclined surface 45 of transverse section 60, creating a resultant camming force against lid 38 and spring arm 72. This will force lid 38 to move from its first position (FIG. 3A), moving slots 14 and 17 out of alignment, as shown in FIG. 3B.

If cardboard 32 is removed, the restoring force provided by spring arm 72 will drive lid 38 back toward deck 46 until second coin track 56 meets deck 46 and lid 38 returns to its normally closed position for normal operation. If cardboard 32 is completely inserted, slots 14 and 17 will remain non-aligned and entrance blocker 42 will prevent an unsuspecting customer from inserting a coin into the obstructed machine. Customers can either see the blockage, feel the misaligned coin impact blocker 42 as they attempt to insert the coin, or feel their coin encountering the foreign matter blocking the entryway 12. By severely restricting the buildup of jammed coins, if any, coin entryway 12 discourages vandals.

Figure 5B:
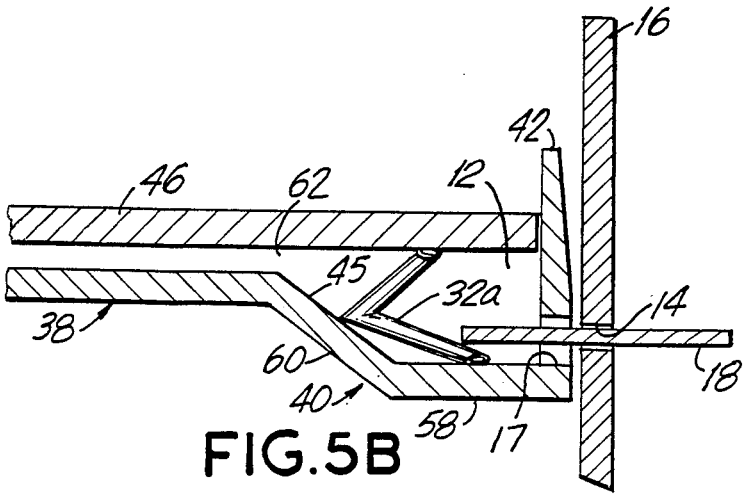
FIG. 5B shows a coin being inserted into an entryway obstructed by a matchbook cover or folded straw.

If less stiff foreign matter is inserted into entryway 12, such as folded drinking straw 32*a* shown in FIG. 5B, there might not be enough insertion force to move the lid 38, from its normal closed position. Even if there was enough force initially to move lid 38, drinking straw 32*a*, completely inserted into chamber 48 could allow the lid 38 to return to its normal position. Such material would then still partially obstruct exit 62 of entryway 12, however, as shown in FIG. 5B. Due to the shortness of length L of parallel section 58, the movement of coin 18 toward exit 62 could be stopped by foreign matter 32*a* before coin 18 has been competely inserted into slot 14. A customer, feeling the obstruction blocking the insertion of coin 18 could, therefore, remove the coin.

If coin 18 is forced into entryway 12 despite the obstruction, the force against inclined surface 45 of transverse section 60 causes a resultant camming force rotating lid 38 about torsion spring 64, as was discussed above in relation to stiff foreign matter 32. This force will move lid 38 from its first position, bringing slots 14 and 17 out of alignment. No additional coins can therefore be inserted, foiling the scam and protecting future customers. In addition, no more foreign matter can be inserted into the telephone.

A coin obstructed in this fashion may be disengaged by the use of the reject lever 86, shown in FIGS. 1 and 4 as described below. The reject lever 86 rotates about a boss 88 molded onto the deck 46. An inclined surface 90 is an integral part of the reject lever 86. This inclined surface 90 is driven against a pin 92, which is connected to the lid 38, by rotation of reject lever 86 in the counterclockwise direction. This rotation forces the pin 92 upward, rotating lid 38 against the force of the torsion spring 64. After the release of the reject lever 86, lid 38 returns to its normal closed position. Repeated, forceful rotations of reject lever 86, called flagging in the art, tend to loosen a coin or coins jammed by an obstruction caused by foreign matter. Where the coin mechanism 10 is used with a standard coin operated telephone, the reject lever 86 is connected with a suitable linkage to the standard coin return lever (not shown) located on the front face of the telephone box.

As discussed above, second track 56, which begins at point 54; only meets deck 46 when lid 38 is in its normal closed position, thereby providing a continuous pathway to the coin directing chute 36. Movement of lid 38 due to the rotation of reject lever 86 opens up an area for coin 18 to fall into. This area, referred to as the reject chute 34, extends between the dashed lines 34*a* and 34*b* of FIG. 1. Flagging of reject lever 86 tends to disengage coin 18 from foreign matter 32 and then to open up the reject chute 34, which directs the released coin 18 to the coin return slot 110.

We claim:

1. A jam reducing apparatus for use in a coin operated machine having a front panel with a coin insert slot, said apparatus comprising:

a lid having an extended portion and a flared end with an inclined inner surface, said flared end having an integral entrance blocker substantially parallel to the front panel of the coin operated machine;

a deck substantially parallel to the extended portion of the lid, said deck connected to a first inclined coin track starting proximate to the front panel and providing a pathway into said machine;

the lid, deck and coin track defining a coin entryway proximate the front panel of said machine for directing a coin into said machine, access to said entryway being gained through an entrance slot in the entrance blocker;

said lid and deck being hingedly mounted together so that the lid has a normally closed position wherein said panel slot and said entrance slot are in substantial alignment, said lid being spring biased by a spring for providing a restoring force tending to restore said lid to said first normally closed position;

said lid subject to movement from said normally closed position due to a sufficient camming force exerted upon the inclined inner surface of the flared end of the lid of said entryway such that when the lid moves from the normally closed position, said coin insert slot and said coin entrance slot move out of alignment.

2. Jam reducing apparatus as in claim 1 wherein the spring has a spring constant selected so that sufficient camming force to misalign the coin entrance slot and the coin insert slot will be caused by the insertion of foreign matter into the coin entryway.

3. Jam reducing apparatus as in claim 1 wherein said lid further comprises a second inclined coin track which begins at the point where said first coin track ends such that a coin traveling along said pathway first moves along said first coin track and then along said second coin track, with no disruption in its motion, said second coin track covering a reject chute;

said apparatus further comprising a coin reject lever, rotation of which moves said lid from the normally closed position, such that said second coin track no longer covers said reject chute and a coin can fall into said reject chute and be returned.

4. Jam reducing apparatus as in claim 1, wherein said coin operated machine is a coin operated telephone.

* * * * *

UNITED STATES PATENT AND TRADEMARK OFFICE
CERTIFICATE OF CORRECTION

PATENT NO. : 4,842,120

DATED : June 27, 1989

INVENTOR(S) : Dobbins, Bob, M.; Regan, Raymond D.; Zouzoulas, John

It is certified that error appears in the above—identified patent and that said Letters Patent is hereby corrected as shown below:

In line 8 of the Abstract replace -- as -- with -- is --; and

Col. 4, line 28, replace "56" with -- 57--.

Signed and Sealed this

Twelfth Day of March, 1991

*Attest:*

HARRY F. MANBECK, JR.

*Attesting Officer*

*Commissioner of Patents and Trademarks*